US010285888B2

(12) United States Patent
Liu

(10) Patent No.: US 10,285,888 B2
(45) Date of Patent: May 14, 2019

(54) INFLATABLE STRETCHER

(71) Applicant: CAREMED SUPPLY INC., New Taipei (TW)

(72) Inventor: Oscar Liu, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 327 days.

(21) Appl. No.: 15/408,091

(22) Filed: Jan. 17, 2017

(65) Prior Publication Data

US 2018/0200130 A1 Jul. 19, 2018

(51) Int. Cl.

| | |
|---|---|
| ***A61G 1/01*** | (2006.01) |
| ***A61G 7/10*** | (2006.01) |
| ***A61G 1/044*** | (2006.01) |
| ***A61G 1/048*** | (2006.01) |

(52) U.S. Cl.

CPC ..... *A61G 7/1021* (2013.01); *A61G 7/1028* (2013.01); *A61G 1/01* (2013.01); *A61G 1/044* (2013.01); *A61G 1/048* (2013.01)

(58) Field of Classification Search

CPC ..... A61G 7/1021; A61G 7/1028; A61G 1/01; A61G 1/048; A61G 1/044

See application file for complete search history.

(56) References Cited

U.S. PATENT DOCUMENTS 5,561,873 A * 10/1996 Weedling ..... A61G 7/1028 5/703
6,073,291 A * 6/2000 Davis ..... A61B 6/0485 414/676
9,849,053 B2 * 12/2017 Rigoni ..... A61G 7/05715
2005/0034242 A1 * 2/2005 Davis ..... A61G 7/1026 5/711
2005/0076437 A1 * 4/2005 Johnson ..... A61G 7/1028 5/81.1 R
2006/0000016 A1 * 1/2006 Weedling ..... A61G 7/1028 5/81.1 HS
2006/0021133 A1 * 2/2006 Davis ..... A61G 7/1028 5/81.1 R
2008/0289102 A1 * 11/2008 Davis ..... A61G 1/013 5/81.1 R

* cited by examiner

*Primary Examiner* — Robert G Santos
*Assistant Examiner* — Myles A Throop
(74) *Attorney, Agent, or Firm* — Rabin & Berdo, P.C.

(57) ABSTRACT

An inflatable stretcher includes an upper and a lower cover member connected along their outer peripheral edges to define an internal air space. The lower cover member has a plurality of perforations forming an overall pattern contoured to the shape of a human body. First and second partitioning member are disposed in the air space and connected to the upper and lower cover members to divide the air space into a plurality of widthwise-extended air release passages and two lengthwise-extended air flow passages located at two lateral sides of the air release passages. A flow opening is formed between each second partitioning member and each corresponding first partitioning member. The flow openings respectively have a cross-sectional area smaller than that of each air release passage, enabling air supplied from an inflation device into the air space to produce an increased air lifting force at positions corresponding to a patient's hips.

10 Claims, 12 Drawing Sheets

INFLATABLE STRETCHER

FIELD OF THE INVENTION

The present invention relates to an inflatable stretcher for carrying a patient thereon, and more particularly to an inflatable stretcher that can be quickly inflated and enables operators to conveniently transfer the patient lying thereon to another support surface.

BACKGROUND OF THE INVENTION

In the past, it is relatively difficult to manually move an immovable patient, such as an injured person in an accident, an aged person or other disabled persons, onto a bed or a stretcher that provides a support surface, and at least two or three nursing personnel are needed to laboriously complete this work. To solve this problem, an inflatable stretcher has been developed and introduced into the market to enable easy transport of an immovable patient with fewer operators.

The conventional inflatable stretcher usually has a plurality of perforations formed on a bottom surface thereof. When using the conventional inflatable stretcher, first position the inflatable stretcher with the perforated bottom surface facing toward a support surface that is fixedly located below the inflatable stretcher. The support surface can be, for example, a floor surface, a bed or a table top. When the inflatable stretcher filled with air is subjected to pressure, the air in the inflatable stretcher will be automatically released from the inflatable stretcher via the perforations to produce continuous pressurized air streams, which together form supporting airflow with an upward lifting force between the bottom surface of the inflatable stretcher and the support surface. Therefore, the nursing personnel or operators can move the patient with less effort.

Further, the conventional inflatable stretcher is internally provided with a plurality of widthwise-extended connection members, which divide an air space in the conventional inflatable stretcher into a plurality of air passages. With these air passages, the whole inflatable stretcher can be uniformly expanded when being inflated with air. In addition, the conventional inflatable stretcher has an outer peripheral edge higher than a central area thereof to protect the patient from falling off when being transported on the conventional inflatable stretcher.

It is noted the supporting airflow released from the bottom surface of the conventional inflatable stretcher is uniformly distributed over the entire bottom surface of the inflatable stretcher to support and lift all parts of the patient at the same time. However, the weight of the patient lying on the inflatable stretcher is not always uniformly distributed over the whole bottom surface of the inflatable stretcher. Therefore, some areas of the conventional inflatable stretcher that are compressed by the lying patient will require more time to be lifted up when compared with other areas that are not compressed by the patient's weight. That is, with the conventional inflatable stretcher, a longer time is needed to lift up the patient from the inflatable stretcher. Since the patient becoming immovable usually requires an urgent medical treatment, it is desirable to shorten the time needed to move the immovable patient from the inflatable stretcher onto a medical support surface and increase the chances of successfully saving the immovable patient's life. In conclusion, the conventional inflatable stretcher still needs improvement.

SUMMARY OF THE INVENTION

A primary object of the present invention is to overcome the disadvantages of the prior art inflatable stretcher by providing an improved inflatable stretcher, which has a plurality of perforations formed on a lower cover member thereof and arrayed corresponding to the shape of a human body, so that an increased air lifting force can be formed at positions of the inflatable stretcher over where a large part of a lying patient's body weight is distributed, enabling operators to conveniently move the inflatable stretcher and the patient lying thereon.

Another object of the present invention is to provide an inflatable stretcher that provides two opposite air inlets, so that the inflatable stretcher can be normally inflated by connecting one inflation device to one of the air inlets or be more quickly inflated by connecting two inflation devices to both of the air inlets, making the inflatable stretcher more convenient for use.

A further object of the present invention is to provide an inflatable stretcher that includes holding elements for stably holding the inflation devices to the inflatable stretcher, so that the inflation devices won't separate from the inflatable stretcher in the process of inflating the inflatable stretcher.

To achieve the above and other objects, the inflatable stretcher provided according to the present invention is configured for carrying a patient thereon and enables operators to conveniently transfer the patient from the inflatable stretcher to another support surface. The inflatable stretcher of the present invention includes an upper cover member, a lower cover member, a plurality of first partitioning members, a plurality of second partitioning members, a first inflation inlet forming member, and a second inflation inlet forming member.

The upper cover member has a lengthwise-extended upper peripheral edge, the lower cover member has a lengthwise-extended lower peripheral edge and is provided with a plurality of perforations. The lower peripheral edge of the lower cover member is fixedly connected to the upper peripheral edge of the upper cover member to define an air space between the upper and the lower cover member. The perforations are arrayed lengthwise on the lower cover member to form an overall pattern that is contoured to the shape of a human body.

Each of the first partitioning members has an upper edge and a lower edge connected to an inner surface of the upper cover member and an inner surface of the lower cover member, respectively. The first partitioning members are widthwise spaced from one another in the air space to thereby define a plurality of widthwise-extended air release passages in the air space.

Each of the second partitioning members has an upper edge and a lower edge connected to an inner surface of the upper cover member and an inner surface of the lower cover member, respectively. The second partitioning members are disposed in the air space at positions close to two opposite ends of the first partitioning members, such that a flow opening is formed between each second partitioning member and each first partitioning member that is located adjacent to the second partitioning member. The flow openings respectively have a cross-sectional area smaller than that of each air release passage. In an operable embodiment, the second partitioning members are located within a central area of the air space.

The first inflation inlet forming member is connected to between the upper peripheral edge and the lower peripheral edge to thereby define a first air-in passage. The first air-in passage has a first air inlet, which is communicable with an external environment, and a plurality of first air delivery ports, which are communicable with the air space. The second inflation inlet forming member is disposed immediately below the first inflation inlet forming member and connected to between the upper peripheral edge and the lower peripheral edge to thereby define a second air-in passage. The second air-in passage has a second air inlet, which is communicable with an external environment, and a plurality of second air delivery ports, which are communicable with the air space.

The first inflation inlet forming member is connected along two opposite widthwise-extended longer sides to between the upper and the lower cover member to define the first air-in passage. The first inflation inlet forming member has two opposite lengthwise-extended shorter sides, one of which is fully connected to between the upper and the lower cover member while the other one is only partially connected to between the upper and the lower cover member to form the first air inlet. The second inflation inlet forming member is connected along two opposite widthwise-extended longer sides to between the upper and the lower cover member to define the second air-in passage. The second inflation inlet forming member also has two opposite lengthwise-extended shorter sides, one of which is fully connected to between the upper and the lower cover member while the other one is only partially connected to between the upper and the lower cover member to form the second air inlet. The second air inlet and the first air inlet are oriented in two opposite directions.

The upper cover member has a plurality of lift-up sections formed along the upper peripheral edge, and the lower cover member has a plurality of pull-down sections formed along the lower peripheral edge in correspondence to the lift-up sections. The first air inlet is located adjacent to two corresponding lift-up section and pull-down section while the second air inlet is located adjacent to another two corresponding lift-up section and pull-down section. The lift-up sections and the corresponding pull-down sections can be moved toward and pressed against one another to close the first air inlet and the second air inlet, or can be moved away from one another to open the first and the second air inlet.

The inflatable stretcher further includes a plurality of connection strips, which respectively have an end fixedly connected to one of the upper cover member and the lower cover member and another opposite end detachably connected to the other one of the upper cover member and the lower cover member. In addition, one of the upper cover member and the lower cover member is provided with at least one holding element for connecting to an air hose of the inflation device.

In a preferred embodiment, the first air inlet of the inflatable stretcher is detachably connected to one inflation device. Air supplied by the inflation device first expands the first air-in passage, bringing the first air-in passage to compress and reduce a volume of the second air-in passage. The overall pattern formed by the perforations consists of a left outer pattern, a middle pattern and a right outer pattern, which are sequentially spaced widthwise on the lower cover member. The middle pattern is lengthwise divided into an upper-half portion and two laterally spaced lower-half portions, and the lower-half portions respectively have a width smaller than that of the upper-half portion.

In another preferred embodiment, the first and the second air inlet of the inflatable stretcher are respectively detachably connected to one inflation device. Air supplied by the two inflation devices expands the first air-in passage and the second air-in passage at the same time. The overall pattern formed by the perforations consists of a left outer pattern, a left inner pattern, a right inner pattern and a right outer pattern, which are sequentially spaced widthwise on the lower cover member. The left inner pattern and the right inner pattern are respectively lengthwise divided into an upper-half portion and a lower-half portion; and the lower-half portions respectively have a width smaller than that of the upper-half portions. It is noted the left inner pattern and the right inner pattern are mirror images of each other.

Further, the air space also includes two air flow passages located at two lateral sides of the air release passages; and the first air delivery ports and the second air delivery ports respectively have an opening facing toward the air flow passages.

The present invention is characterized in that the flow openings formed between the second partitioning members and the first partitioning members respectively have a cross-sectional area smaller than that of each air release passage, enabling air supplied from the inflation device into the air space to produce an increased air lifting force at positions corresponding to a lying patient's hips. Further, by superposing the first inflation inlet forming member on the second inflation inlet forming member, the operators can conveniently select, depending on actual need of use, to inflate the inflatable stretcher from one side or two sides thereof. In the case of inflating from two sides of the inflatable stretcher, the inflating time can be shortened. Moreover, the provision of the lift-up sections, the pull-down sections, the connection strips and the holding elements on the inflatable stretcher work together to stably hold the air hoses of the inflation devices in place. Therefore, it is able to avoid undesired separation of the air hoses from the inflatable stretcher in the process of inflating.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and by referring to the accompanying drawings.

Figure 1:
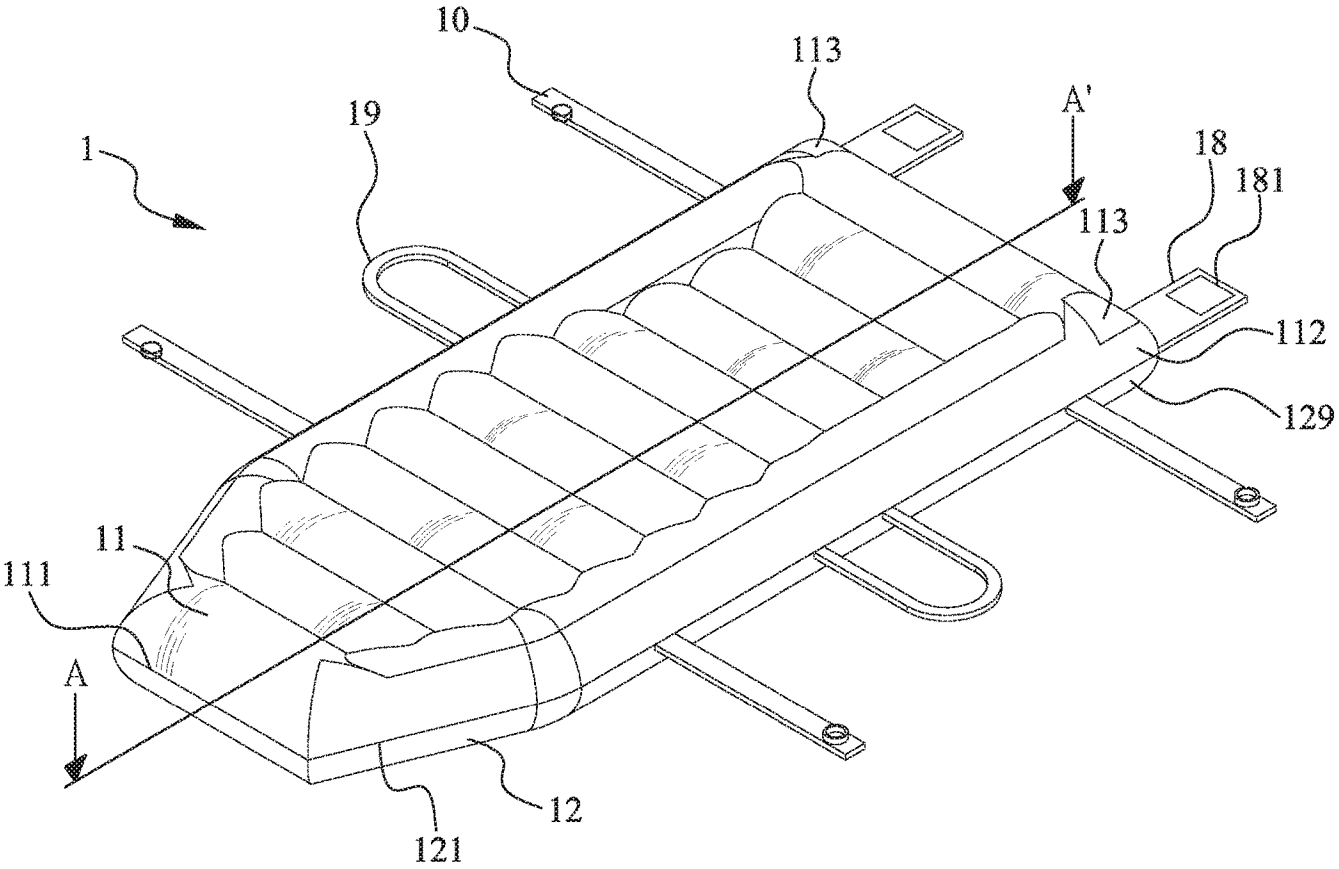
FIG. 1 is a perspective view of an inflatable stretcher according to a preferred embodiment of the present invention in a fully inflated state.

Please refer to FIG. 1. The inflatable stretcher according to a preferred embodiment of the present invention is generally denoted by reference numeral 1 and is formed of an upper cover member 11 and a lower cover member 12 that are connected together to define an outer configuration of the inflatable stretcher 1. The upper cover member 11 has a lengthwise-extended upper peripheral edge 111, and the lower cover member 12 has a lengthwise-extended lower peripheral edge 121. The upper and the lower cover member 11, 12 are fixedly connected together along the upper and the lower peripheral edge 111, 121 to form a bed-like support surface for a patient to lie flat thereon. It is noted the upper and the lower cover member 11, 12 respectively have two front corners that are beveled, so that the inflatable stretcher 1 has a tapered front end that is suitable for supporting the patient's head thereon and enables an operator to conveniently use the inflatable stretcher 1 in a right direction.

Figure 5:
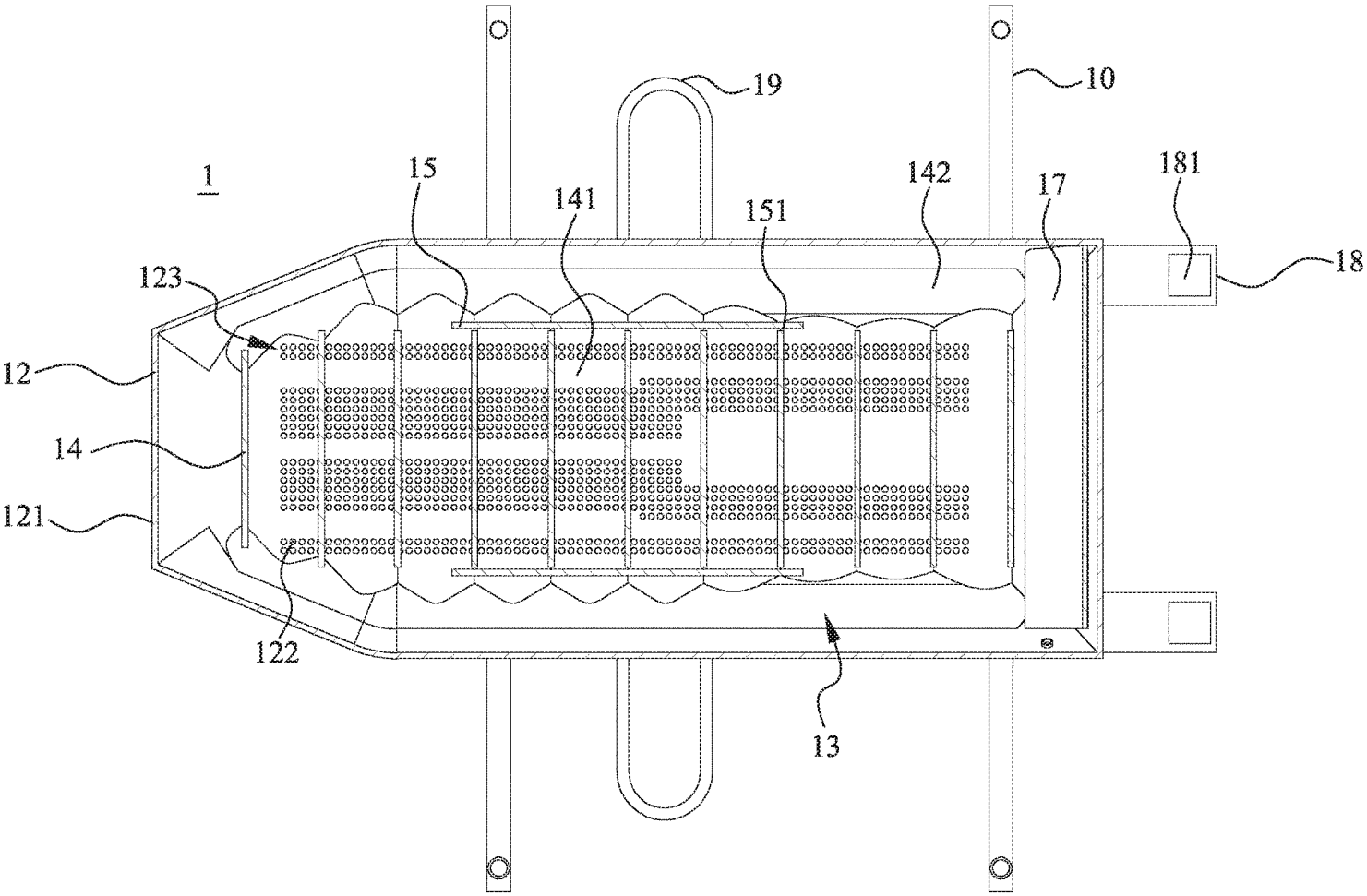
FIG. 5 is a sectional view taken along line A-A' of FIG. 1.
Figure 10:
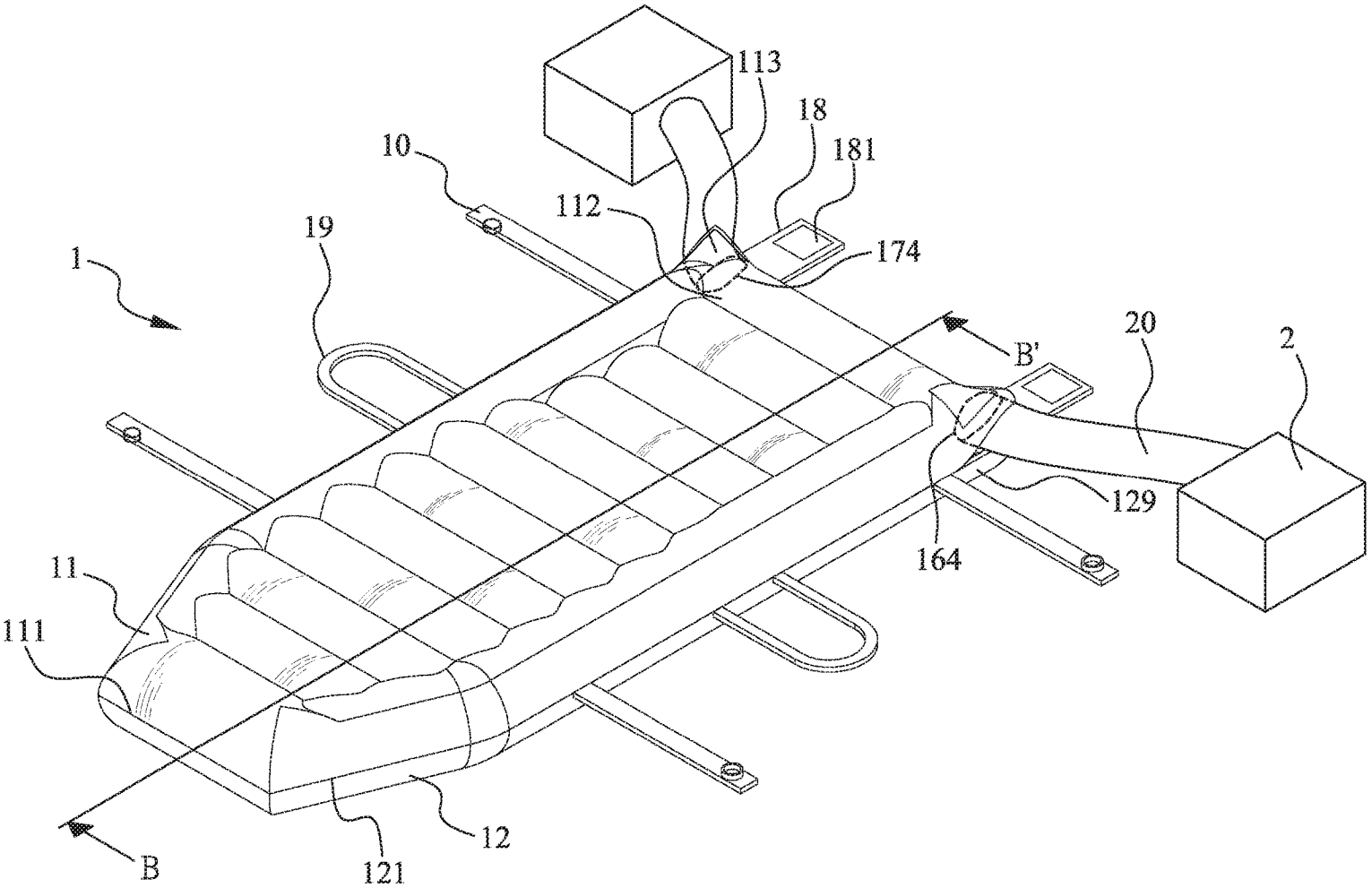
FIG. 10 shows the inflatable stretcher according to the present invention is connected to two inflation devices to be inflated from two opposite sides thereof.
Figure 12:
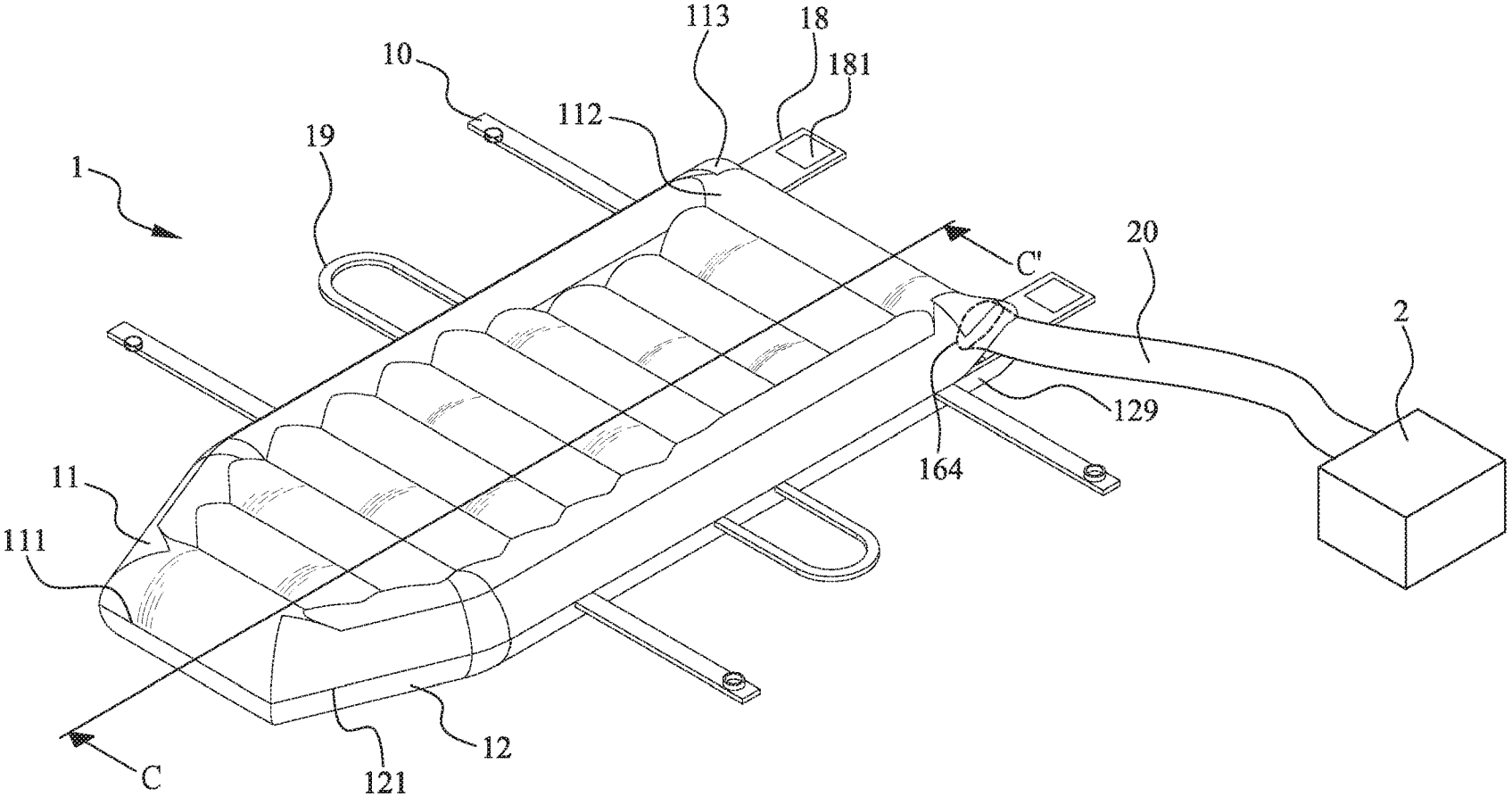
FIG. 12 is a perspective view showing the inflatable stretcher according to the present invention is connected to only one inflation device to be inflated from one side thereof.

The inflatable stretcher 1 can be inflated using one or two inflation devices 2, as shown in FIGS. 10 and 12, respectively. When the inflatable stretcher 1 is in a deflated state, the upper and the lower cover member 11, 12 are in contact with each other and looked like a flat piece (not shown). On the other hand, when the inflatable stretcher 1 is inflated using the inflation device 2, an air space 13 as indicated in FIG. 5 is formed between the upper and the lower cover member 11, 12 to separate the two cover members from each other.

Figure 2:
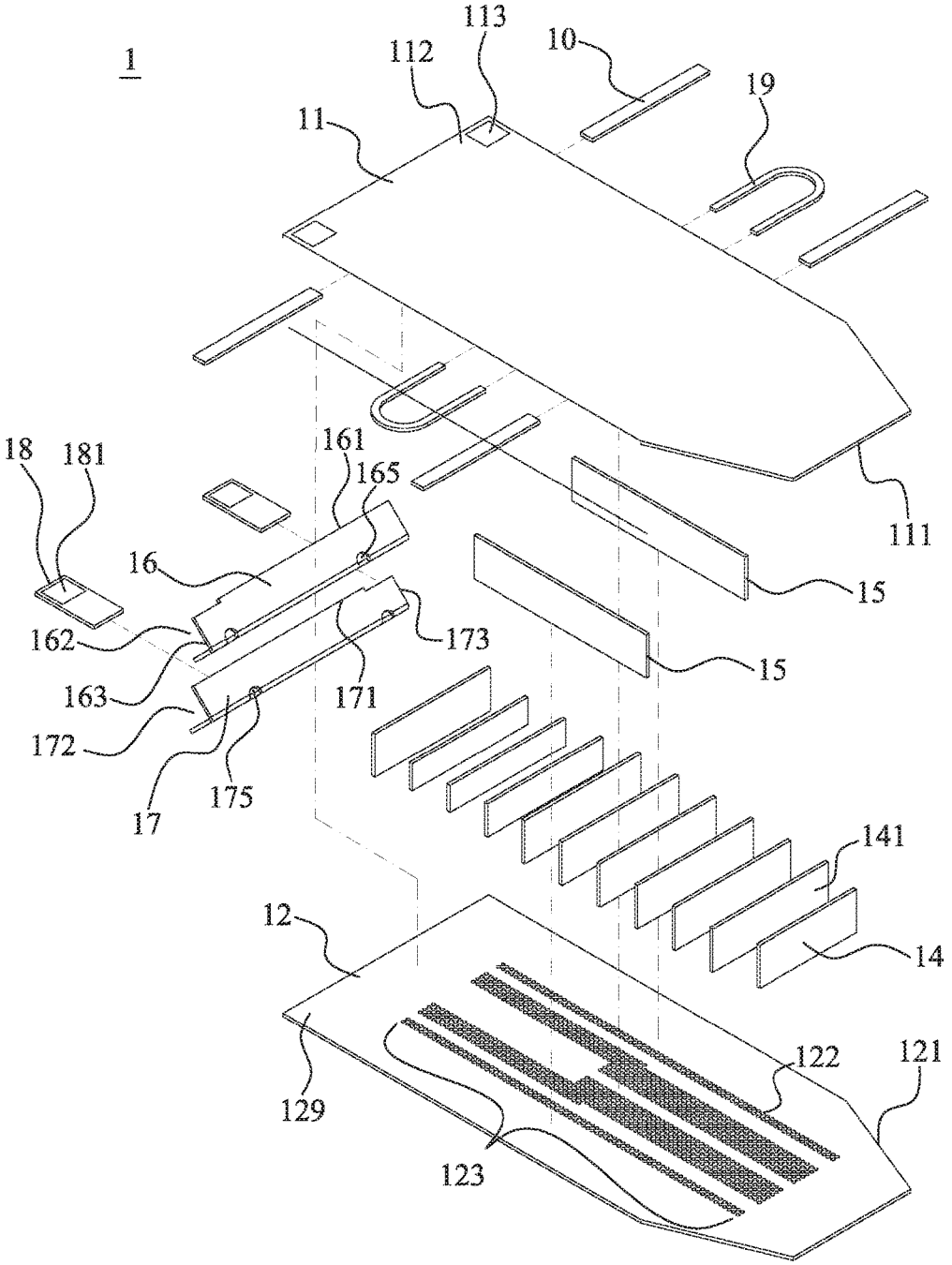
FIG. 2 is an exploded view of FIG. 1.
Figure 3:
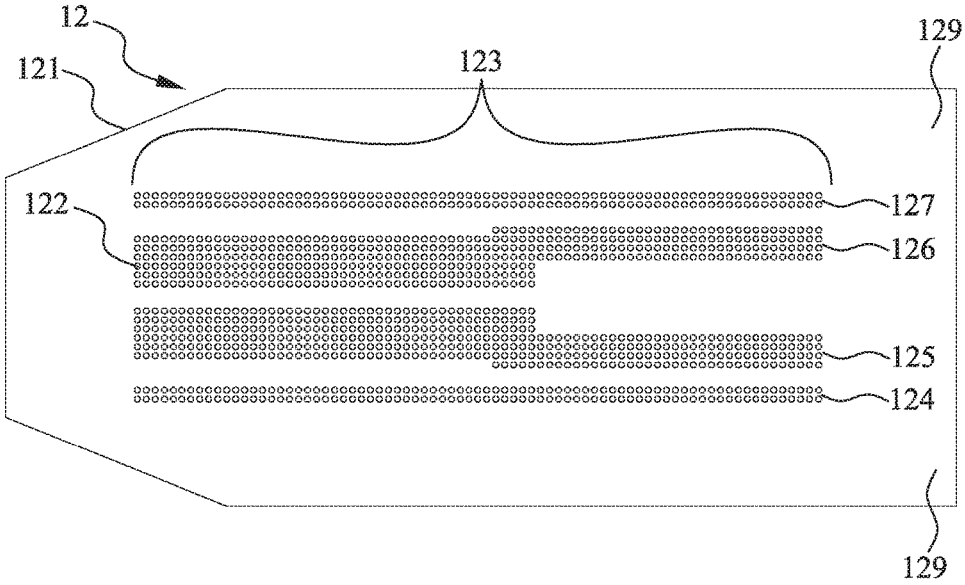
FIG. 3 is a plan view showing a first perforation pattern formed on a lower cover member of the inflatable stretcher according to the present invention.

Please refer to FIGS. 2 and 3. The lower cover member 12 has a plurality of perforations 122 formed thereon. The perforations 122 are arrayed lengthwise on the lower cover member 12 to form an overall pattern 123 that is contoured corresponding to the shape of a human body. In a first preferred embodiment as shown in FIG. 3, the overall pattern 123 consists of a left outer pattern 124, a left inner pattern 125, a right inner pattern 126 and a right outer pattern 127, which are sequentially spaced widthwise on the lower cover member 12. The left inner pattern 125 and the right inner pattern 126 are respectively lengthwise divided into an upper-half portion and a lower-half portion, and the lower-half portion has a width smaller than that of the upper-half portion. Further, the left inner pattern 125 and the right inner pattern 126 are mirror images of each other.

Figure 4:
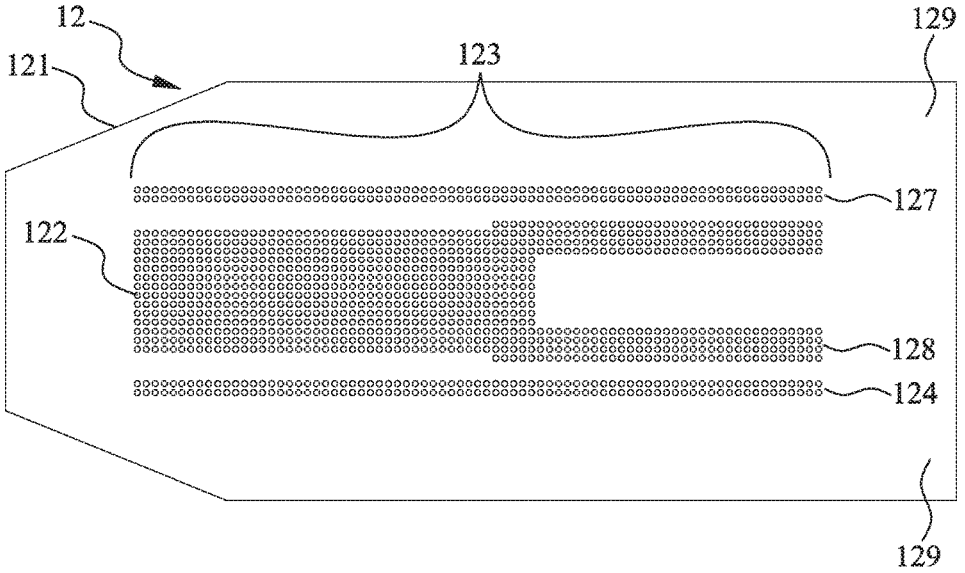
FIG. 4 is a plan view showing a second perforation pattern formed on the lower cover member of the inflatable stretcher according to the present invention.

Please refer to FIG. 4. In a second preferred embodiment, the overall pattern 123 consists of a left outer pattern 124, a middle pattern 128 and a right outer pattern 127, which are sequentially spaced widthwise on the lower cover member 12. The middle pattern 128 is lengthwise divided into an upper-half portion and two laterally spaced lower-half portions, and the lower-half portions respectively have a width smaller than that of the middle pattern 128.

When the perforations 122 are arrayed according to the first or the second preferred embodiment, an air lifting force produced by the air in the inflatable stretcher 1 can directly act on the trunk and limbs of the patient lying on the inflatable stretcher 1, enabling the inflatable stretcher 1 to more quickly lift the patient to a higher position.

Please refer to FIGS. 2 and 5. The inflatable stretcher 1 of the present invention further includes a plurality of first partitioning members 14, a plurality of second partitioning members 15, a first inflation inlet forming member 16 and a second inflation inlet forming member 17, all of which are disposed in the air space 13 between the upper and the lower cover member 11, 12.

Each of the first partitioning members 14 has an upper edge and a lower edge connected to an inner surface of the upper cover member 11 and an inner surface of the lower cover member 12, respectively. The first partitioning members 14 are transversely disposed in the air space 13 to parallelly space from one another, so as to define a plurality of widthwise-extended air release passages 141 in a central area of the air space 13, as well as a lengthwise-extended air flow passage 142 at each of two lateral sides of the air space 13. In the illustrated preferred embodiment, part of the first partitioning members 14 that are disposed in the air space 13 at positions corresponding to a user's head, trunk and hips are uniform in height, while other first partitioning members 14 that are disposed in the air space 13 at positions between the user's (i.e. the patient's) hips and feet have a decreased height to form a slightly recessed area.

Each of the second partitioning members 15 also has an upper edge and a lower edge connected to the inner surface of the upper cover member 11 and the inner surface of the lower cover member 12, respectively. The second partitioning members 15 are disposed in the air space 13 at positions close to two opposite ends of the first partitioning members 14. In the illustrated preferred embodiment, the second partitioning members 15 are located perpendicular to the first partitioning members 14 and within the central area of the air space 13; such that a flow opening 151 is formed between each second partitioning member 15 and each first partitioning member 14 that is located adjacent to the second partitioning member 15. The flow openings 151 respectively have a width, which is the closest or the vertical distance from the end of each first partitioning member 14 to the adjacent second partitioning member 15. Therefore, the flow openings 151 respectively have a cross-sectional area smaller than that of each air release passage 141. Further, the flow openings 151 are distributed in the air space 13 at positions generally corresponding to two lateral sides of the patient's hips when the patient is lying on the inflatable stretcher 1, such that the air lifting force provided by the air in the inflatable stretcher 1 at areas corresponding to the patient's hips is higher than other areas.

Figure 6:
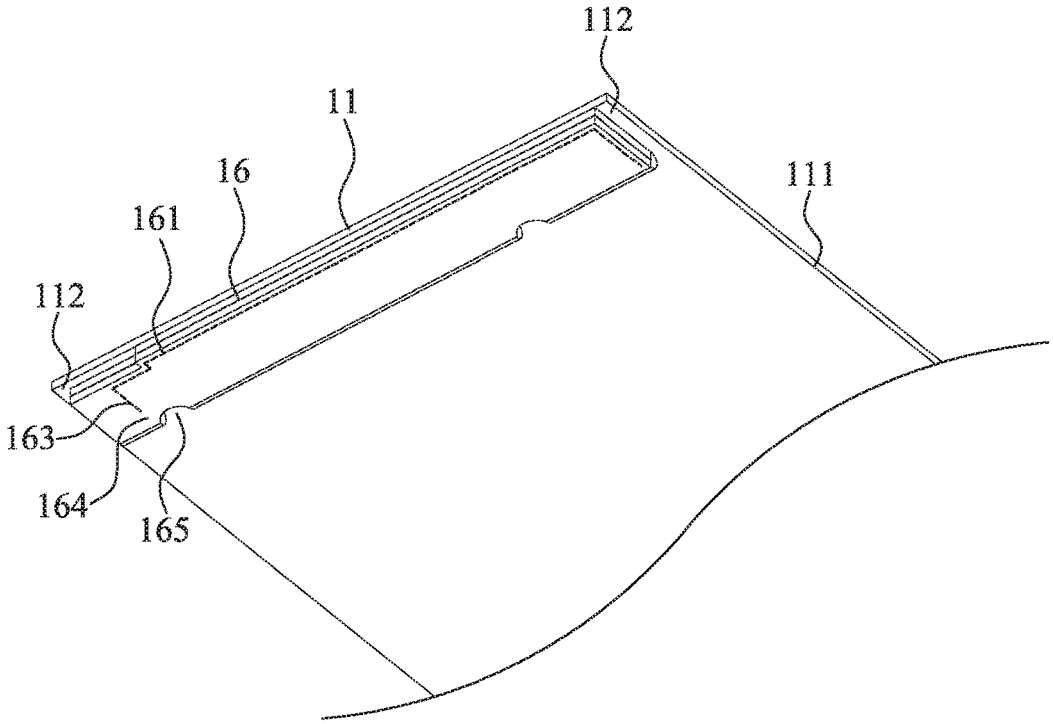
FIG. 6 shows the connection of a first inflation inlet forming member to an upper cover member of the inflatable stretcher according to the present invention.
Figure 11:
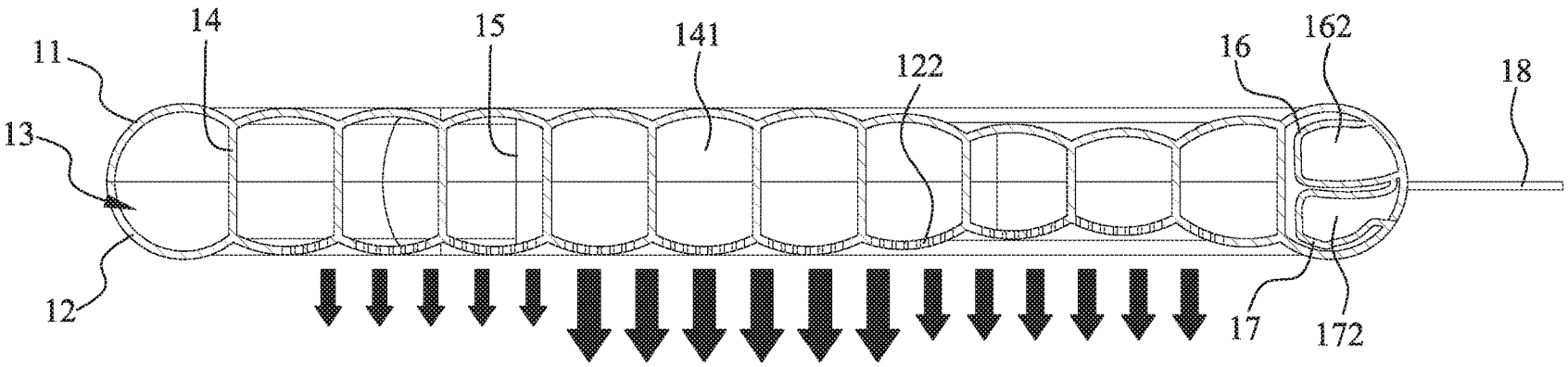
FIG. 11 is a sectional view taken along line B-B' of FIG. 10.

Referring to FIGS. 2 and 6. The first inflation inlet forming member 16 is bent to a U shape and is connected along two opposite widthwise-extended longer sides 161 to between the upper and the lower cover member 11, 12, as indicated by the phantom line in FIG. 6, such that an inner surface of the U-shaped first inflation inlet forming member 16 define a first air-in passage 162, as shown in FIG. 11. It is noted one of two lengthwise-extended U-bent shorter sides 163 of the first inflation inlet forming member 16 is fully connected to between the upper and the lower cover member 11, 12, while the other U-bent shorter side 163 is only partially connected to between the upper and the lower cover member 11, 12, as shown by the phantom line in FIG. 6. The portion of the other U-bent shorter side 163 that is not unconnected to the upper and the lower cover member forms a first air inlet 164. The first inflation inlet forming member 16 is provided with a plurality of first air delivery ports 165, which are communicable with the air space 13 and respectively have an opening facing toward the air flow passages 142 in the air space 13.

Figure 7:
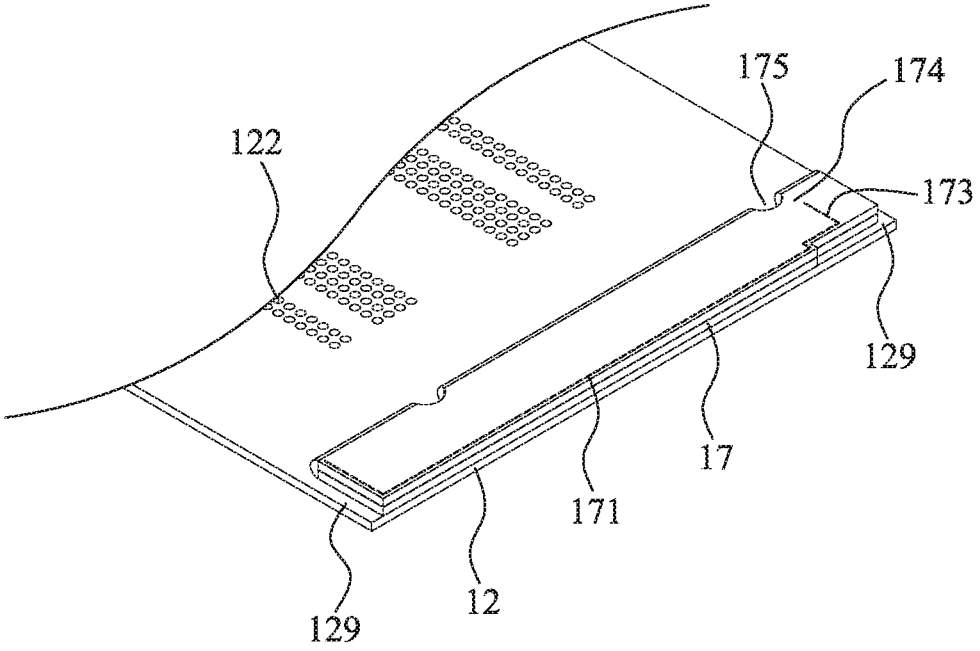
FIG. 7 shows the connection of a second inflation inlet forming member to the lower cover member of the inflatable stretcher according to the present invention.

Please refer to FIGS. 2 and 7. The second inflation inlet forming member 17 is also bent to a U shape and is connected along two opposite widthwise-extended longer sides 171 to between the upper and the lower cover member 11, 12, as indicated by the phantom line in FIG. 7, such that the second inflation inlet forming member 17 is disposed immediately below the first inflation inlet forming member 16. An inner surface of the U-shaped second inflation inlet forming member 17 defines a second air-in passage 172, as shown in FIG. 11. It is noted one of two lengthwise-extended U-bent shorter sides 173 of the second inflation inlet forming member 17 is fully connected to between the upper and the lower cover member 11, 12, while the other U-bent shorter side 173 is only partially connected to between the upper and the lower cover member 11, 12, as shown by the phantom line in FIG. 7. The portion of the other U-bent shorter side 173 that is not connected to the upper and the lower cover member forms a second air inlet 174. It is also noted the second air inlet 174 and the first air inlet 164 are oriented in two opposite directions. The second inflation inlet forming member 17 is provided with a plurality of second air delivery ports 175, which are communicable with the air space 13 and similarly respectively have an opening facing toward the air flow passages 142 in the air space 13.

Figure 8:
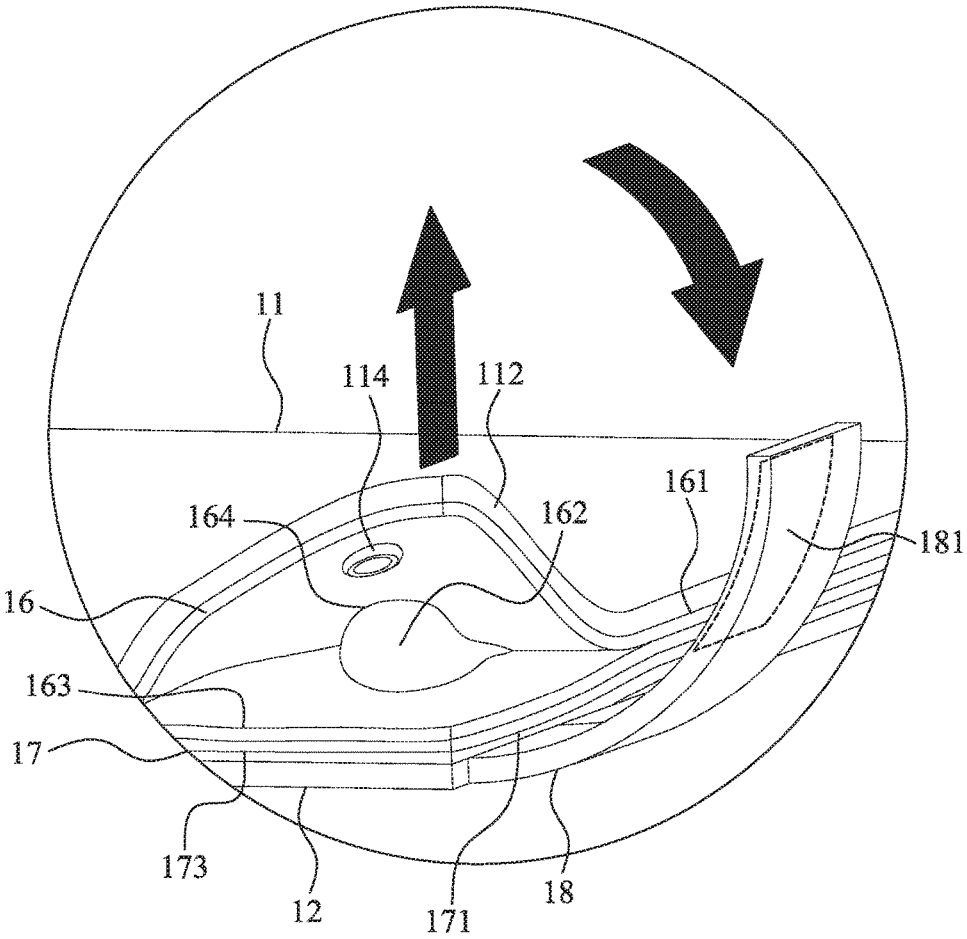
FIG. 8 shows the upper cover member and the first inflation inlet forming member are partially lifted to open a first air inlet of the inflatable stretcher according to the present invention.
Figure 9:
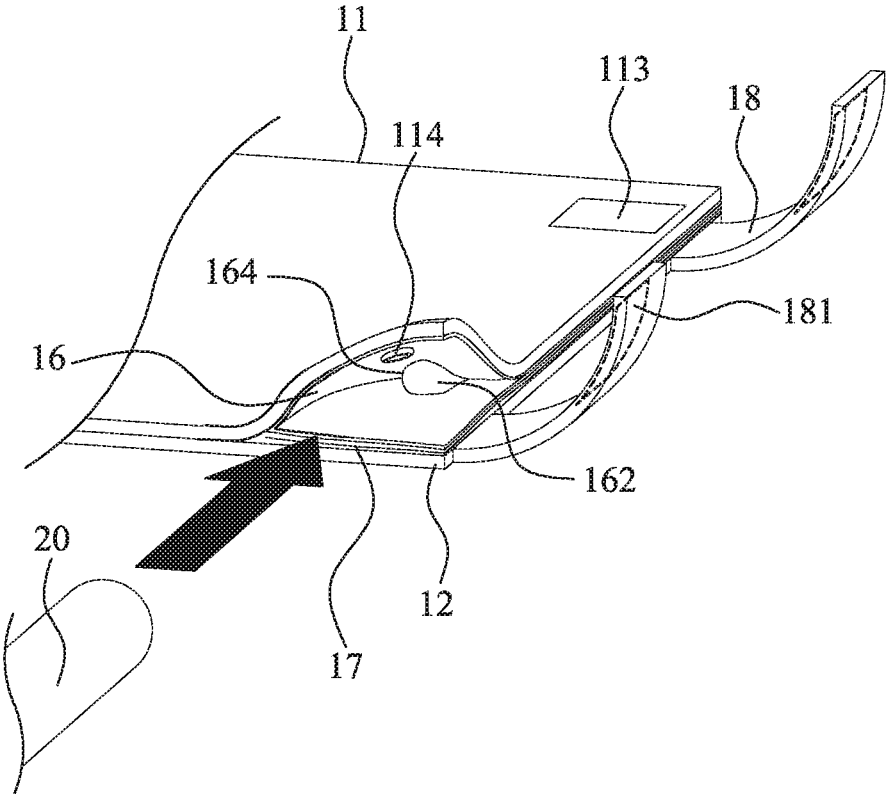
FIG. 9 shows the coupling of an inflation device to the inflatable stretcher according to the present invention.

Please refer to FIGS. 6 and 7 along with FIGS. 8 and 9. The upper cover member 11 has a plurality of lift-up sections 112 formed along the upper peripheral edge 111, and the lower cover member 12 has a plurality of pull-down sections 129 formed along the lower peripheral edge 121. The first air inlet 164 is located adjacent to two corresponding lift-up section 112 and pull-down section 129; and the second air inlet 174 is located adjacent to another two corresponding lift-up section 112 and pull-down section 129. More specifically, the lift-up sections 112 can be simultaneously or independently moved toward and pressed against the corresponding pull-down sections 129 to close the first air inlet 164 and/or the second air inlet 174, or can be simultaneously or independently lifted up and separated from the corresponding pull-down sections 129 to open the first and/or the second air inlet 164, 174.

Please refer back to FIG. 2. The inflatable stretcher 1 further includes a plurality of connection strips 18, a plurality of handles 19 and a plurality of fastening straps 10. The connection strips 18 respectively have an end fixedly connected to the lift-up sections 112 on the upper cover member 11 or the pull-down sections 129 on the lower cover member 12, and another end detachably connected to the lower cover member 12 or the upper cover member 11. The handles 19 allow the operators to conveniently move the whole inflatable stretcher 1; and the fastening straps 10 are used to hold the patient in place on the inflatable stretcher 1. In addition, one of the upper cover member 11 and the lower cover member 12 is provided with holding elements, to each of which an air hose 20 of the inflation device 2 is connected.

As can be seen in FIG. 2, the upper cover member 11 is provided on an outer surface with a plurality of hook tapes 113 and the connection strips 18 are respectively provided on an inner surface with a loop tape 181 in correspondence to the hook tapes 113, such that the loop tapes 181 are detachably fastened to the hook tapes 113. As shown in FIGS. 8 and 9, the above-mentioned holding elements can be configured as female fasteners 114 provided on the upper cover member 11 and the air hose 20 can be provided with a male fastener (not shown) corresponding to the female fastener 114. When the air hose 20 has been partially inserted in the first air inlet 164 or the second air inlet 174 by a predetermined length, the air hose 20 can be held in place through engagement of the female fastener 114 with the male fastener. Meanwhile, the connection strip 18 corresponding to the first or the second air inlet 164, 174 can also be turned to attach to the upper or the lower cover member 11, 12 via connection of the loop tape 181 to the hook tape 113. With these arrangements, the air hose 20 is prevented from undesired separation from the inflatable stretcher 1 when the latter is being inflated.

The handles 19 and the fastening straps 10 all are fixedly connected to between the upper cover member 11 and the lower cover member 12, and are symmetrically located at the left and the right side of the inflatable stretcher 1. The handles 19 enable the operators to conveniently pull or move the inflatable stretcher 1, and the fastening straps 10 are used to hold the patient in place on the inflatable stretcher 1 so that the patient won't fall off the inflatable stretcher 1 when being transported.

Please refer to FIGS. 10 and 11. Two inflation devices 2 can be connected to the first and the second air inlet 164, 174 at the same time for supplying air into the inflatable stretcher 1. In this case, the first air-in passage 162 and the second air-in passage 172 are expanded simultaneously to thereby mutually limit their expansion dimensions, which in turn shortens the time needed to fully inflate the inflatable stretcher 1.

Figure 13:
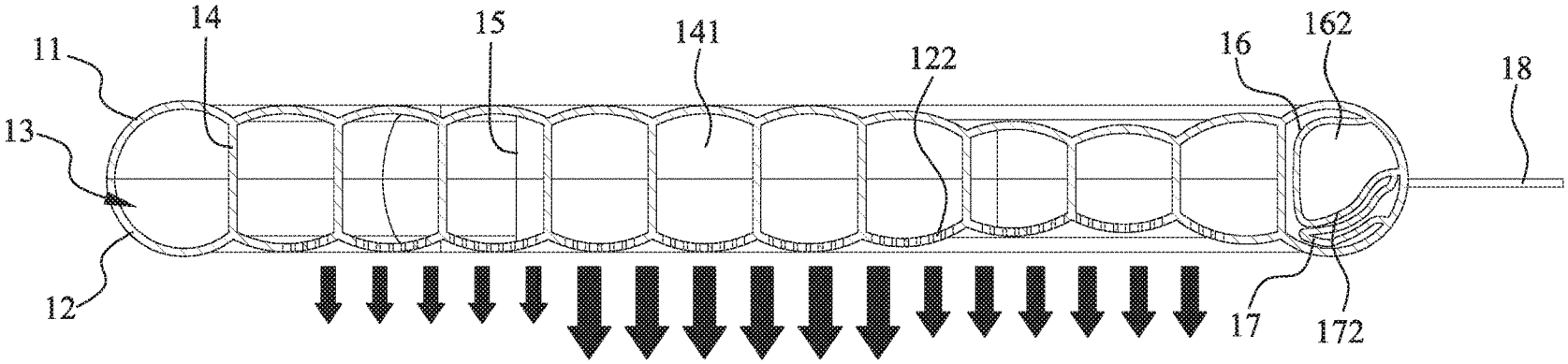
FIG. 13 is a sectional view taken along line C-C' of FIG. 12.

Alternatively, as shown in FIGS. 12 and 13, only one inflation device 2 is connected to the first air inlet 164 for supplying air into the inflatable stretcher 1. In this case, the first inflation inlet forming member 16 alone is expanded, allowing the first air-in passage 162 to continuously expand in volume to compress and reduce the volume of the second air-in passage 172 until the second inflation inlet forming member 17 is fully bent to a flat configuration. In this case, the second air inlet 174 is not communicable with the second air delivery ports 175, allowing all the air supplied by the inflation device 2 into the inflatable stretcher 1 to release from the perforations 122 on the lower cover member 12. However, it is understood the connection of only one inflation device 2 to the first air inlet 164 is only illustrative. In other operable embodiment of the present invention, the only one inflation device 2 can be otherwise connected to the second air inlet 174 for supplying air into the inflatable stretcher 1. In this case, the first air inlet 164 would finally become not communicable with the first air delivery ports 165 when the first air-in passage 162 is fully compressed by the expanded second air-in passage 172.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An inflatable stretcher for carrying a patient thereon and enabling convenient transfer of the patient to another support surface, comprising:

an upper cover member having a lengthwise-extended upper peripheral edge;

a lower cover member having a lengthwise-extended lower peripheral edge and provided with a plurality of perforations; the lower peripheral edge being fixedly connected to the upper peripheral edge of the upper cover member to define an air space between the upper and the lower cover member; and the perforations being arrayed lengthwise on the lower cover member to form an overall pattern that is contoured to the shape of a human body;

a plurality of first partitioning members, each of which having an upper edge and a lower edge connected to an inner surface of the upper cover member and an inner surface of the lower cover member, respectively; and the first partitioning members being spaced from one another in the air space to thereby define a plurality of widthwise-extended air release passages in the air space;

a plurality of second partitioning members, each of which having an upper edge and a lower edge connected to the inner surface of the upper cover member and the inner surface of the lower cover member, respectively; the second partitioning members being disposed in the air space at positions close to two opposite ends of the first partitioning members, such that a flow opening is formed between each second partitioning member and each first partitioning member that is located adjacent to the second partitioning member; the flow openings respectively having a cross-sectional area smaller than that of each air release passage; and the second partitioning members being located within a central area of the air space;

a first inflation inlet forming member being connected to an area between the upper peripheral edge and the lower peripheral edge to thereby define a first air-in passage; and the first air-in passage having a first air inlet, which is communicable with an external environment, and a plurality of first air delivery ports, which are communicable with the air space; and a second inflation inlet forming member being disposed immediately below the first inflation inlet forming member and connected to the area between the upper peripheral edge and the lower peripheral edge to thereby define a second air-in passage; and the second air-in passage having a second air inlet, which is communicable with an external environment, and a plurality of second air delivery ports, which are communicable with the air space.

2. The inflatable stretcher as claimed in claim 1, wherein the first inflation inlet forming member is connected along two opposite widthwise-extended longer sides to between the upper and the lower cover member to define the first air-in passage; and wherein the first inflation inlet forming member has two opposite lengthwise-extended shorter sides, one of which is fully connected to between the upper and the lower cover member while the other one is only partially connected to between the upper and the lower cover member to form the first air inlet.

3. The inflatable stretcher as claimed in claim 2, wherein the second inflation inlet forming member is connected along two opposite widthwise-extended longer sides to between the upper and the lower cover member to define the second air-in passage; and wherein the second inflation inlet forming member has two opposite lengthwise-extended shorter sides, one of which is fully connected to between the upper and the lower cover member while the other one is only partially connected to between the upper and the lower cover member to form the second air inlet; and wherein the second air inlet and the first air inlet are oriented in two opposite directions.

4. The inflatable stretcher as claimed in claim 1, wherein the upper cover member has a plurality of lift-up sections formed along the upper peripheral edge and the lower cover member has a plurality of pull-down sections formed along the lower peripheral edge in correspondence to the lift-up sections; the first air inlet being located adjacent to the respective corresponding lift-up section and the respective corresponding pull-down section, and the second air inlet being located adjacent to a different respective corresponding lift-up section and a different respective corresponding pull-down section; and the lift-up sections and the corresponding pull-down sections being adapted to move toward and press against one another to close the first air inlet and the second air inlet, or to move away from one another to open the first and the second air inlet.

5. The inflatable stretcher as claimed in claim 4, further comprising a plurality of connection strips; the connection strips respectively having an end fixedly connected to one of the upper cover member and the lower cover member and another opposite end detachably connected to the other one of the upper cover member and the lower cover member.

6. The inflatable stretcher as claimed in claim 1, wherein the first air inlet is detachably connected to an inflation device; the inflation device supplying air into the air space and the supplied air first expanding the first air-in passage, bringing the first air-in passage to compress and reduce a volume of the second air-in passage.

7. The inflatable stretcher as claimed in claim 1, wherein the first and the second air inlet are respectively detachably connected to an inflation device; the inflation devices supplying air into the air space and the supplied air expanding the first air-in passage and the second air-in passage at the same time.

8. The inflatable stretcher as claimed in claim 1, wherein the air space further includes two air flow passages located at two lateral sides of the air release passages; and the first air delivery ports and the second air delivery ports respectively having an opening facing toward the air flow passages.

9. The inflatable stretcher as claimed in claim 1, wherein the overall pattern consists of a left outer pattern, a middle pattern and a right outer pattern, which are sequentially spaced widthwise on the lower cover member; the middle pattern being lengthwise divided into an upper-half portion and two laterally spaced lower-half portions, and the lower-half portions respectively having a width smaller than that of the upper-half portion.

10. The inflatable stretcher as claimed in claim 1, wherein the overall pattern consists of a left outer pattern, a left inner pattern, a right inner pattern and a right outer pattern, which are sequentially spaced widthwise on the lower cover member; the left inner pattern and the right inner pattern being respectively lengthwise divided into an upper-half portion and a lower-half portion; the lower-half portions having a width smaller than that of the upper-half portions; and the left inner pattern and the right inner pattern are mirror images of each other.

* * * * *